US008646302B2

(12) United States Patent
Lety et al.

(10) Patent No.: US 8,646,302 B2
(45) Date of Patent: Feb. 11, 2014

(54) METHOD FOR SHAPING FROM A BLANK OF A HARDENING MATERIAL WITH DIFFERENTIAL COOLING

(75) Inventors: Jean Jacques Lety, Bouville (FR); Stéphane Anquetil, Mareil-sur-Mauldre (FR); Laurent Barromes, Arcueil (FR); Sophie Sebrier, Beauvilliers (FR)

(73) Assignee: Thyssenkrupp Sofedit, Le Theil (FR)

( * ) Notice: Subject to any disclaimer, the term of this patent is extended or adjusted under 35 U.S.C. 154(b) by 576 days.

(21) Appl. No.: 12/933,874

(22) PCT Filed: Feb. 26, 2009

(86) PCT No.: PCT/EP2009/052289

§ 371 (c)(1), (2), (4) Date: Sep. 21, 2010

(87) PCT Pub. No.: WO2009/106571

PCT Pub. Date: Sep. 3, 2009

(65) Prior Publication Data

US 2011/0030442 A1 Feb. 10, 2011

(30) Foreign Application Priority Data

Feb. 26, 2008 (FR) ..... 08 51201

(51) Int. Cl.
*B21D 37/16* (2006.01)

(52) U.S. Cl.
USPC ..... 72/342.7; 72/342.94

(58) Field of Classification Search
USPC ..... 72/342.1, 342.3, 342.4, 342.5, 342.6, 72/342.7, 342.8, 348, 347, 364
See application file for complete search history.

(56) References Cited

U.S. PATENT DOCUMENTS 3,703,093 A * 11/1972 Komatsu et al. ..... 72/342.4
5,916,389 A 6/1999 Lundstrom
6,524,404 B2 * 2/2003 Gehringhoff et al. ..... 148/320

(Continued)

FOREIGN PATENT DOCUMENTS

DE 10 2005 032 113 B3 2/2007
DE 10 2006 019 395 A1 10/2007

(Continued)

*Primary Examiner* — Edward Tolan
(74) *Attorney, Agent, or Firm* — Blakely Sokoloff Taylor & Zafman

(57) ABSTRACT

The invention relates to a drawing tool (1) for shaping and cooling a steel part from a blank (6), said tool including: at least one punch (2); and at least one matrix (3); the punch and the matrix each including: at least a first portion (21, 31) corresponding to a hot area (11) of the drawing tool; and at least a second portion (22, 32) corresponding to a cold area (12) of the drawing tool; in the cold area, the second part of the punch and the second part of the matrix are brought into contact with the blank when the drawing tool is closed; characterized in that, in the hot area of the drawing tool, a heating means are provided for heating said hot area to a temperature higher than about 400° C., and in that, in said hot area, a distance (L) on top of the blank thickness (e) is provided between the punch and the matrix when the drawing tool is closed, is related to the temperature (T) of the hot area, and is given by the formula $T=100\cdot(6-L)$, with $L>0.2$ and $400\leq T<600$; L being in mm and T in ° C.

6 Claims, 3 Drawing Sheets

(56) References Cited

U.S. PATENT DOCUMENTS

| | | | | |
|---|---|---|---|---|
| 6,742,374 | B2 * | 6/2004 | Ozawa | 72/342.5 |
| 8,118,954 | B2 * | 2/2012 | Beenken et al. | 148/714 |
| 8,202,376 | B2 * | 6/2012 | Gehringhoff et al. | 148/643 |
| 8,272,245 | B2 * | 9/2012 | Salamon et al. | 72/364 |
| 8,424,356 | B2 * | 4/2013 | Tanabe et al. | 72/342.5 |
| 2002/0104591 | A1 | 8/2002 | Gehringhoff et al. | |
| 2002/0113041 | A1 | 8/2002 | Ozawa | |

FOREIGN PATENT DOCUMENTS

| | | | | |
|---|---|---|---|---|
| EP | 0 816 520 | A2 | 1/1998 | |
| JP | 1-118320 | * | 5/1989 | B21D 22/20 |
| JP | 5-212485 | * | 8/1993 | B41J 5/02 |
| JP | 2002-282951 | A | 10/2002 | |
| JP | 2003-328031 | A | 11/2003 | |
| JP | 2005-205416 | A | 8/2005 | |
| WO | WO 2006/038868 | A1 | 4/2006 | |
| WO | 2006/128821 | * | 12/2006 | B21D 37/16 |

* cited by examiner

METHOD FOR SHAPING FROM A BLANK OF A HARDENING MATERIAL WITH DIFFERENTIAL COOLING is a non-provisional application claiming the benefit of International application number PCT/EP2009/952289 filed Feb. 26, 2009.

The present invention concerns methods for heat shaping with cooling. More particularly, the present invention concerns methods for heat shaping from a blank of a hardening material with differential cooling.

A drawing method with hardening of a piece in a hardening material in a same tool is known and is described in document JP 2005-205416. In this method, a blank is shaped using a drawing tool. After drawing, while the piece is still kept in the tool, hardening is done via contact between the tool and the drawn blank. In addition to this contact, cold water is circulated in the pipes provided to that end in the drawing tool, which makes it possible to accelerate the cooling.

However, for certain steel pieces, it would be useful to be able to perform hardening only on part of the piece. For example, in the automobile field, it would be advantageous to be able to produce a center pillar having areas with different mechanical characteristics. Thus certain areas can be made or kept ductile in order to improve shock absorption during a collision.

Today, this type of piece is made in two or several parts using different shaping and cooling methods. The two or several parts are then adhered together using welding techniques well known by those skilled in the art.

The method used today is therefore time-consuming and costly in terms of equipment. Moreover, the welding portion is a fragile zone that presents a risk for the user during a shock.

Document U.S. Pat. No. 5,916,389 also describes such a method in which a steel object is obtained. This steel object is made up of different parts whereof the material is in different structural states; some parts are hard, and others remain ductile.

Several possibilities are proposed to keep a more ductile structure of the steel in certain locations:

- heating elements can be provided in a punch and a matrix of a drawing tool; or
- indentations are provided in the punch and the matrix of the drawing tool, such that when the punch and the matrix come into contact with the steel blank, there is no contact where the indentations are; i.e. where the steel must remain ductile.

However, the end-of-production mechanical properties depend closely on the cooling speed. Solely using the heating means or solely using indentations does not make it possible to obtain the necessary results on the mechanical properties.

Document US 2002/0104591 describes a method in which a center pillar is formed with two portions having different mechanical properties. A first portion corresponding to the upper portion of the center pillar has a martensitic structure with a mechanical resistance beyond 1400 N/mm$^2$. A second portion corresponding to the lower portion of the center pillar has a ferritic-pearlitic structure and a mechanical resistance less than 850 N/mm$^2$ (about 500 N/mm$^2$) and an elongation of less than 25% (preferably 20%).

In order to obtain a center pillar having two portions with different mechanical properties, the lower portion, that must remain ductile, is protected from the heat during heating at an austenitic temperature. Thus, the lower portion of the center pillar is not in an austenitic state at the end of the heating and therefore will not be able to be hardened to obtain a martensitic structure.

This method has the following drawback: when the blank remains in the furnace longer than necessary (even only slightly longer), the transition zone between the hardened and unhardened portions may widen.

Document US 2002/0113041 describes a method for heat shaping with differential hardening, having several embodiments:

- a first embodiment consists of carrying out the same method as described in document US 2002/0104591 with only a small number of differences;
- a second embodiment consists of using a drawing tool having cooling means where hardening is desired;
- in a third embodiment, the drawing tool has different portions made of different materials, having different heat conductivity values.

The inventors tried to obtain pieces made of hardened steel having the desired mechanical properties by using materials with low conductivity (for example concrete having a conductivity in the vicinity of 2 $W \cdot m^{-1} \cdot K^{-1}$) for the drawing tool. The obtained results were not convincing. Also, a low conductivity of the material does not prevent the first pieces in production from being hardened because they are in contact with the cold tool.

Document DE 10 2006 019 395 A1 describes a method in which the drawing tool comprises a matrix, a punch and a blank holder. The three elements of the drawing tool can be heated to different temperatures. However, only examples where all three parts are heated to an identical temperature are given. The method consists of heating the drawing tool to a temperature between 200 and 650° C.

For a temperature below 200° C., the elongation $A_{80}$ is about 5%, and the mechanical resistance above 1500 MPa. For a temperature above 200° C., the elongation $A_{80}$ is greater than 5.8% and the mechanical resistance is below 1500 MPa. For a temperature of 400° C., the mechanical resistance is 820 MPa and the elongation $A_{80}$ is 10%.

When the temperature decreases from 790° C. to 390° C., a cooling speed of about 80 to 115 K/s is measured (it would appear that this is valid for a tool temperature above 200° C.). The structure of the steel is then fine grained martensitic. For a tool temperature below 200° C., a cooling speed of about 80 to 480 K/s is measured. In this case, the structure of the steel is coarse grained martensitic.

However, the conditions under which these tests were conducted does not make it possible to obtain the desired mechanical properties, i.e. an elongation $A_{80}$ greater than about 15% and a mechanical resistance $R_m$ greater than 500 MPa.

It is only at the cost of a selection of cooling conditions that the inventors succeeded in obtaining a hardened steel object with satisfactory mechanical properties.

The inventors filed a patent application on Aug. 1, 2007 under Ser. No. 07/56863. This application describes a heat shaping method with differential hardening from a tube, in which a tube is heated to an austenitizing temperature, then shaped and cooled in a drawing tool, having heating means, through injection of a coolant through the cavity of the tube. This heating means makes it possible to prevent the material from becoming mar ensitic in certain locations.

Although this method works for tubes, it is not applicable to shaping a blank due to the difference in the geometry.

One aim of the present invention is to propose a method making it possible to obtain a piece drawn from a steel blank and whereof the mechanical characteristics can cover an entire range of possible mechanical characteristics between those of an unprocessed steel and those of a hardened steel.

Another aim of the present invention is to propose a method not requiring the traditional tempering step of a drawn and hardened piece.

Another auxiliary aim of the present invention is to grant different mechanical resistance and elongation properties of the material to different parts of a same piece, as desired by a person skilled in the art.

To that end, the present invention proposes a drawing tool for shaping and cooling a steel piece from a blank, the tool comprising:

at least one punch; and at least one matrix;

the punch and the matrix each comprising:

at least a first portion corresponding to a hot area of the drawing tool; and at least a second portion corresponding to a cold area of the drawing tool;

in the cold area, the second part of the punch and the second part of the matrix are brought into contact with the blank when the drawing tool is closed; and characterized in that, in the hot area of the drawing tool, a heating means is provided for heating said hot area to a temperature higher than about 400° C.; and in that, in the hot area, a distance in addition to the blank thickness is provided between the punch and the matrix when the drawing tool is closed, is related to the temperature (T) of the hot area, and is given by the formula:

$$T=100\cdot(6-L),$$

with L>0.2 and 400≤T<600, L being expressed in mm and T in ° C.

Other preferred but non-limiting features of this drawing tool are:

on one shaping face of the first portion of the tool, at least one protrusion is provided;

on one shaping face of the first portion of the matrix, at least one protrusion is provided;

in the first portion of the punch, the heating means are at least partially provided;

in the first portion of the matrix, the heating means are at least partially provided;

the drawing tool has air play between the cold area and the hot area.

The present invention also proposes a shaping and cooling method using the drawing tool according to any one of the preceding claims, the method comprising the steps consisting of:

heating the blank to an austenitic temperature;

placing the blank in the drawing tool;

closing the drawing tool on the blank; and removing the shaped piece from the drawing tool;

characterized in that the hot area of the drawing tool is brought to a temperature above 400° C. owing to the heating means.

Other preferred but non-limiting features of said method are:

the heating temperature of the hot area of the drawing tool is below about 600° C.;

in the hot area, cooling is done at a speed between about 5° C./sec and about 15° C./sec;

in the cold area, cooling is done at a speed between about 27° C./sec and about 100° C./sec.

Other features, aims and advantages will appear upon reading the following description, based on the drawings provided as examples, in which.

In the rest of the description, the elongation-at-break values are understood as test values obtained on an $A_{80}$ test specimen.

Figure 1:
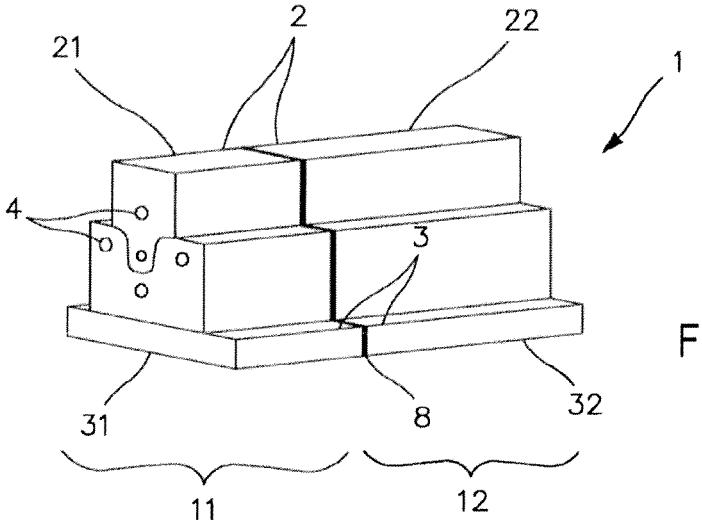
FIG. 1 is a schematic perspective view of a drawing tool according to the present invention.

A drawing tool 1 according to the invention will be described in reference to FIG. 1.

The drawing tool 1 includes a set of punches 2 and a set of matrices 3. The set of punches 2 and the set of matrices will be called the punch 2 and the matrix 3, respectively, hereinafter.

The matrix 3 has an indentation generally complementary to a relief of the punch 2. The complementarity of this indentation and the relief grants a heated blank 6 a determined shape.

The punch 2 and the matrix 3 have at least two portions 21, 22; 31, 32 corresponding to at least two areas: a hot area 11 and a cold area 12.

In the rest of the description, air play refers to a distance L in addition to a thickness of the blank 6 between the matrix 3 and the punch 2. In other words, if the thickness of the blank 6 is e, a distance d between the matrix and the punch when the drawing tool 1 is closed is:

$$d=L+e.$$

Consequently we will consider hereinafter that there is air play when the distance L is greater than a machining tolerance value necessary for the punch 2 and the matrix 3 to draw. This tolerance is no more than 0.2 mm. Air play then corresponds to a distance L greater than 0.2 mm.

We will also say that there is contact between the drawing tool 1 and the blank 6 if L is less than 0.2 mm.

In a first portion 21 of the punch 2 corresponding to the hot area 11, heating elements 4 are provided.

Alternatively, in a first portion 31 of the matrix 3 corresponding to the hot area 11, heating elements 4 are also provided.

The heating elements 4 are therefore provided either only in the punch 2, or only in the matrix 3, or in both at the same time.

These heating elements 4 make it possible to bring the hot area 11 to a temperature greater than 400° C. and preferably below 600° C.

The heating elements 4 are chosen among cartridge heaters, induction heating devices, thermal jackets.

The use of cartridge heaters is especially well suited to straight drawing tools without too much curvature.

Thermal jackets and induction heating devices can fit curved shapes.

Figure 2:
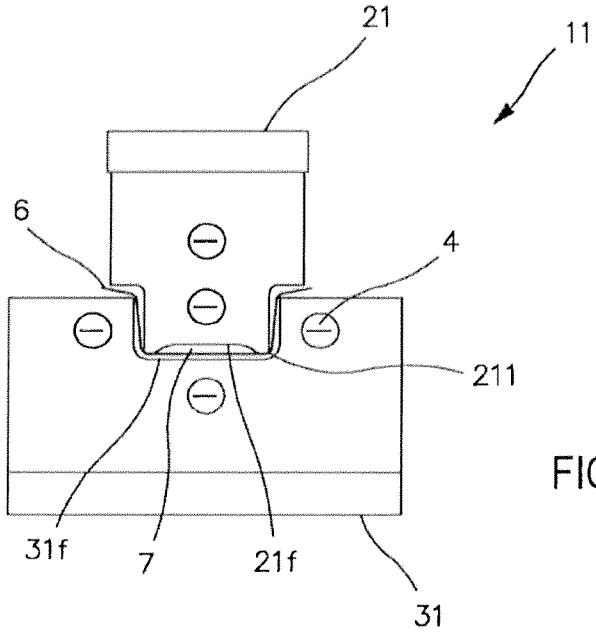
FIG. 2 is a schematic transverse cross-section view of a first portion of the drawing tool comprising heating means.

Described hereinafter in reference to FIG. 2 are the first portions (21 and 31, respectively) of the punch 2 and the matrix 3 corresponding to the hot area 11.

In a first embodiment, the punch 2 and the matrix 3 each have a shaping face (21*f* and 31*f*, respectively). The shaping face 21*f* of the punch 2 is not complementary to the shaping face 31*f* of the matrix 3 so as to leave air play 7, defining a distance L, between the punch 2 and the blank 6 and between the matrix 3 and the blank 6. This air play 7 is less than about 2 mm.

The punch 2 then has, on the shaping face 21*f*, at least one protrusion 211 that abuts against the shaping face 31*f* of the matrix 2 (as shown by FIG. 2). This protrusion 211 has a maximum height of about 2 mm at most.

In a sub-alternative, this protrusion 211 can be present not on the shaping face 21*f* of the punch 2, but on that 31*f* of the matrix 3.

In another sub-alternative, at least one protrusion 211 is present both on the shaping face 21*f* of the punch 2 and that 31*f* of the matrix 3. These protrusions 211 are then opposite each other or not.

In a second embodiment, the punch 2 and the matrix 3 having shaping faces 21*f*, 31*f* that are substantially complementary to each other. Thus, if for example the shaping face 21*f* of the punch 2 has a surface whereof one section is substantially Q-shaped, the shaping face 31*f* of the matrix 3 also has a surface whereof one section is substantially Q-shaped, such that the punch 2 can be inserted in the matrix 3. When the drawing tool 1 is closed, only a smaller space then remains, the thickness of which is filled in by the blank 6 during the shaping.

Figure 3:
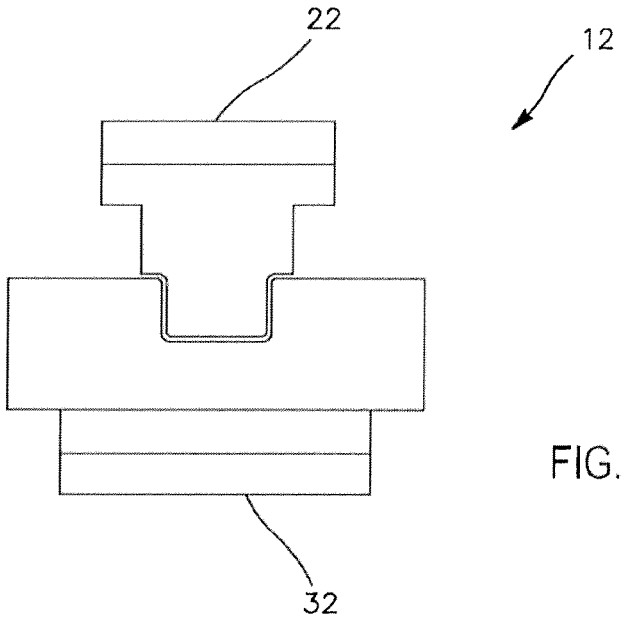
FIG. 3 is a schematic transverse cross-sectional view of a second portion of the drawing tool.

In the portions 22 and 32, of the punch 2 and the matrix 3, respectively, corresponding to the cold area 12, the punch 2 and the matrix 3 have substantially complementary shapes (as shown in FIG. 3). In other words, the punch 2 and the matrix 3 each have a shaping face 21*f*, 31*f* complementary to that 31*f*, 21*f* of the other, with only the thickness.

In a sub-alternative, in the second portions 22, 32 of the punch 2 and the matrix 3, cooling systems are provided, for example water circulation circuits.

When the drawing tool 1 is closed on the blank 6 to be shaped, there is no play present between the blank on one hand and the second portions 22, 32 of the punch 2 and of the matrix 3 on the other hand.

A method according to the invention is described below.

The blank to be shaped 6 is made of steel, for example a boron steel (NE standards EN 10083-1, -2 and -3). But the material of the blank 6 is not limited to boron steels; it can be any type of steel suitable for producing the piece to be shaped.

The blank 6 is brought to a temperature beyond which the structure of the steel becomes austenitic. The blank 6 is then placed in the drawing tool 1 for shaping.

During the shaping, the drawing tool 1 is closed on the blank 6, causing the blank 6, the punch 2 and the matrix 3 to come at least partially into contact.

In the first alternative, there is only contact between:

the blank 6 and the punch 2 where there is a protrusion 211; and/or the blank 6 and the matrix 3 where there is a protrusion 211; and/or the blank and the shaping face 31*f* of the matrix 3; and/or the blank and the shaping face 21*f* of the punch 2;

according to the sub-alternative of the hot area 11 of the drawing tool 1 used; and there cannot be contact both between the blank 6 and the entire shaping face 21*f* of the punch 2 and between the blank 6 and the entire shaping face 31*f* of the matrix 3.

In this first embodiment, the hot area 11 of the drawing tool 1 is brought to a temperature above about 400° C. and below about 600° C.

The necessary air play 7 is connected to the temperature T of the hot area 11 using the following formula:

$$T=100\cdot(6-L),$$

with L>0.2 and 400≤T<600, L being expressed in mm and T in ° C.

The heating of the hot area 11 of the drawing tool 1 as well as the air play 7 work together to allow the temperature to drop at a speed between about 5° C./sec and about 15° C./sec, from a starting temperature of about 900° C. and an ending temperature between about 400° C. and 600° C. The structure of the steel of the blank 6 therefore does not become hard (martensitic), but ductile with a mechanical resistance between about 450 MPa and about 800 MPa; and an elongation greater than about 15%.

In the second embodiment, there is contact between the hot area 11 of the drawing tool 1 and the blank 6, and it is brought to a temperature of about 600° C. When the drawing tool 1 is brought to that temperature, the steel of the blank does not become hard (martensitic), but ductile with a mechanical resistance between about 450 MPa and about 800 MPa; and an elongation between about 15% and about 20%.

In the cold area 12, the blank 6 is formed by closing the drawing tool 1; the punch 2 and the matrix 3 coming into contact with the blank 6 on their respective shaping faces 21*f*, 31*f*. quenching is done, i.e. cooling with a temperature drop whereof the speed is between about 27° C./sec and about 100° C./sec, between a starting temperature of about 900° C. and an ending temperature of about 250° C. The cold area is kept at a temperature of at least for the shaping time. In this cold area 12, the mechanical resistance is between about 1200 MPa and about 1700 MPa; and the elongation is between about 3% and about 7%.

Tests conducted by the inventors of the invention have shown that drawing of a blank 6 with differential heating, in which the drawing tool is brought to a temperature of 250° C. and comprises an air play 7 of mm, grants the pressed piece a mechanical resistance of about 770 MPa and an elongation $A_{80}$ of about 10.5%.

Drawing of a blank 6 with differential hardening, in which the drawing tool is brought to a temperature of 400° C. and comprises an air play 7 of 2 mm, grants the pressed piece a mechanical resistance of about 610 MPa and an elongation $A_{80}$ of about 19.4%.

Drawing of a blank 6 with differential hardening, in which the drawing tool is brought to a temperature of 500° C. and comprises an air play 7 of 1 mm, grants the pressed piece a mechanical resistance of about 570 MPa and an elongation $A_{80}$ of about 21%.

Alternatively, between the cold area 12 and the hot area 11 of the drawing tool 1, air play 8 less than 2 mm is provided. At this area 8, the shaped piece has a transition area in which the hardness of the material goes from 250 by (hot area) to 450 Hv (cold area).

This transition area on the final piece is in the order of 20 mm.

The drawing tool 1 is kept closed long enough (pressing time) for the structure of the material to undergo the desired transformation.

The pressing time is equivalent to the time needed for the quenching of the cold part; i.e. between about 5 and about 15 seconds.

Other operations can be carried out in the drawing tool at the same time as the shaping and cooling: die trimming (cutting the piece out in the pressed tool), calibration (finishing to obtain the correct shape).

One example of an application is provided below, purely as an example. A center pillar is formed from a steel blank 6.

A center pillar 9 is an essentially I-shaped piece (with serif) designed to be placed between the front door and the back door of a vehicle. More precisely, the center pillar 9 includes a central portion 9*a* extending globally vertically and two ends (upper 9*b* and lower 9*c*) each ending with a T (tilted T for the lower end). The center pillar 9 has an essentially Ω-shaped transverse section.

It is advantageous for a vehicle user's safety for the center pillar 9 not to have homogenous mechanical characteristics. Preferably, one seeks to give a first upper portion 92, called cold portion, a high mechanical resistance (between about 1200 MPa and about 1700 MPa) and a low elongation (between about 3% and about 7%) in order to obtain anti-intrusion properties (to protect the passenger); and to give a second lower portion 91, called hot portion, a lower mechanical resistance (between about 450 MPa and about 800 MPa) and a more significant elongation (greater than about 15%), in order to obtain energy absorption properties in case of shock.

Thus, during a collision between vehicles or a shock between the vehicle and an obstacle, the hot portion 91 of the center pillar 9 deforms and absorbs the energy of the shock.

Today, in order to obtain such a center pillar, a car builder manufactures the piece in two separate parts having different mechanical properties as defined above with two different manufacturing methods. The two parts are then assembled to each other, thereby creating a fragile area between the two parts.

In the invention, the center pillar 9 is made in a single piece, which prevents having to resort to an assembly, for example by laser, and therefore makes it possible to eliminate said fragile area.

A steel blank 6 is heated to an austenitic temperature, then placed in the blanking tool 1. The punch 2 and the matrix 3 have shaping faces 21*f*, 31*f* capable of granting the shape of the finished center pillar 9 to the steel blank 6.

The punch 2 and the matrix 3 are made in two zones (11, 21, 31; 12, 22, 32). The cold area 12 corresponds to the upper portion 92 of the center pillar 9, the hot portion 11 corresponds to the lower portion 91 of the center pillar 9.

When the drawing tool 1 is completely closed on the blank 6 for shaping, the punch 2 matrix 3 distance d is defined in the hot area according to the first embodiment of the invention by:

$$d=L+e,$$

where L is the air play 7 and e is the thickness of the blank 6.

In the cold area 12, there is contact between the punch 2 and the blank 6 as well as between the matrix 3 and the blank 6. The temperatures of the hot 11 and cold 12 areas are between about 400° C. and about 600° C. and between about 50° C. and about 150° C., respectively.

According to the second embodiment of the invention, there is contact between the punch 2 and the blank 6 and between the matrix 3 and the blank 6 in both areas. The hot area 11 is then kept at about 600° C. and the cold area 12 between about 50° C. and about 150° C.

Closing the drawing tool 1 on the blank 6 causes the steel to cool.

In the cold area 12, the cooling speed is between about 27° C./sec and about 100° C./sec.

In the hot area 11, the cooling speed is between about 5° C./sec and about 15° C./sec.

Figure 4:
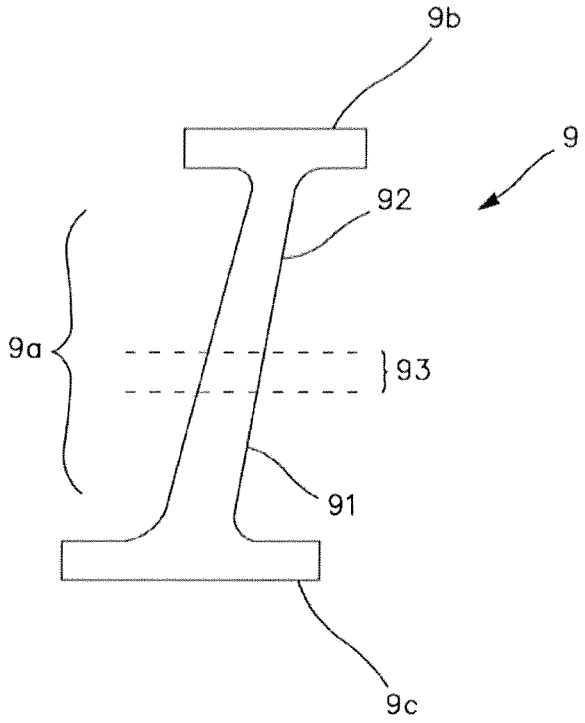
FIG. 4 is a schematic view of a center pillar produced accordingly to the invention.

Between the two areas 11, 12 of the drawing tool 1, air play 8 smaller than 2 mm is provided. Corresponding to this area is a transition area 93 of the shaped piece not exceeding 450 Hv. This area is about 20 mm long (this area is exaggerated in FIG. 4). In this transition area 93, the hardness of the material goes from about 250 Hv near the hot portion 91 to about 450 Hv near the cold portion 92.

The hot portion 91 has a mechanical resistance between about 450 MPa and about 800 MPa; and an elongation greater than 7% and preferably above about 15%.

The cold portion 92 has a mechanical resistance between about 1200 MPa and about 1700 MPa; and an elongation between about 3% and about 7%.

The invention is not limited to the production of center pillars. Thus, the invention makes it possible to obtain drawn pieces including portions having different mechanical properties (anti-intrusion and energy absorption). The method according to the invention also makes it possible to do away with the traditional tempering step after drawing.

Of course, the present invention is in no way limited to the embodiments described above; a person skilled in the art will be able to make any number of alterations or changes to it.

The invention claimed is:

1. A drawing tool for shaping and cooling a steel piece from a blank, the drawing tool comprising:

at least one punch; and at least one matrix;

wherein the punch and the matrix each include:

at least a first portion corresponding to a hot area of the drawing tool; and at least a second portion corresponding to a cold area of the drawing tool;

wherein, in the cold area of the drawing tool, the second portion of the punch and the second portion of the matrix are brought into contact with the blank when the drawing tool is closed; and wherein, in the hot area of the drawing tool, a heater is provided for heating said hot area to a temperature higher than 400° C.; and wherein, in the hot area, a distance (L), in addition to the blank thickness (e) is provided between the punch and the matrix when the drawing tool is closed, is related to the temperature (T) of the hot area, and is given by the formula:

$$T=110\cdot(6-L),$$

with $L>0.2$ and $400\leq T<600$, L being expressed in mm and T in ° C.

2. The drawing tool according to claim 1, wherein on one shaping face of the first portion of the tool, at least one protrusion is provided.

3. The drawing tool according to claim 1, wherein on one shaping face of the first portion of the matrix, at least one protrusion is provided.

4. The drawing tool according to claim 1, wherein, in the first portion of the punch, the heater is at least partially provided.

5. The drawing tool according to claim 1, wherein, in the first portion of the matrix, the heater is at least partially provided.

6. The drawing tool according to claim 1, further having air play between the cold area and the hot area.

* * * * *